US007071156B2

(12) United States Patent
Aubay et al.

(10) Patent No.: US 7,071,156 B2
(45) **Date of Patent: *Jul. 4, 2006**

(54) COMPOSITION BASED ON NANOPARTICLES OR A NANOLATEX OF POLYMERS FOR FABRIC CARE

(75) Inventors: Eric Aubay, Le Perreux sur Marne (FR); Marie-Pierre LaBeau, Paris (FR); Ian Harrison, Maurice Berteaux (FR)

(73) Assignee: Rhodia Chimie, Boulogne-Billancourt Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/901,679

(22) Filed: Jul. 11, 2001

(65) Prior Publication Data

US 2002/0065208 A1 May 30, 2002

(30) Foreign Application Priority Data

Aug. 25, 2000 (FR) ..... 00 10945
Jun. 11, 2001 (FR) ..... 01 07590

(51) Int. Cl.
*C11D 1/00* (2006.01)
*C11D 3/37* (2006.01)
*D06L 1/00* (2006.01)

(52) U.S. Cl. ..... 510/475; 510/276; 510/327; 510/337; 510/360; 510/361; 510/434; 510/515; 8/181; 8/115.54; 8/133; 8/115.56

(58) Field of Classification Search ..... 510/276, 510/327, 337, 360, 361, 434, 475, 515; 8/181, 8/115.54, 133, 115.56
See application file for complete search history.

(56) References Cited

U.S. PATENT DOCUMENTS 3,340,217 A 9/1967 Woodruff
3,544,501 A * 12/1970 Feamley et al. ..... 260/29.6
4,746,455 A * 5/1988 Matsuda et al. ..... 252/174.23

FOREIGN PATENT DOCUMENTS

EP WO 98/00449 * 1/1998
FR 1 416 813 A 1/1966
WO WO 98/00449 A1 1/1998

OTHER PUBLICATIONS

Search Report Issued in French Priority Counterpart, Dated Jun. 22, 2001, Not Translated.

* cited by examiner

*Primary Examiner*—Brian P. Mruk
(74) *Attorney, Agent, or Firm*—Buchanan Ingersoll, P.C.

(57) ABSTRACT

Composition for fabric care, in particular for cotton-based fabrics, comprising nanoparticles or a nanolatex of a polymer which is insoluble under the direct and/or indirect working conditions of the said composition in an aqueous or wet medium. The composition may be a solid or liquid detergent formulation, a liquid rinsing and/or softening formulation, a tumble dryer additive placed in contact with the wet fabrics in a tumble dryer, an aqueous ironing formulation or a prespotter placed on the dry fabrics prior to a washing operation.

13 Claims, No Drawings

COMPOSITION BASED ON NANOPARTICLES OR A NANOLATEX OF POLYMERS FOR FABRIC CARE

The present invention relates to a composition for fabric care, in particular for cotton-based fabrics, comprising nanoparticles or a nanolatex of a polymer which is insoluble under the direct and/or indirect working conditions of the said composition in an aqueous or wet medium.

The expression "fabric care" means the protection of fabrics against physical or chemical degradation phenomena and/or the provision of benefits thereto, for instance softening and/or crease-resistance properties.

The machine washing of fabrics leads to a physical and chemical degradation of the fibres and most particularly of cotton fibres. The alkalinity delivered by detergents and also by certain specific compounds such as oxidizing substances (perborate or percarbonate) or certain enzymes may be the cause of the chemical degradation of cotton fibres. However, it is generally the combination of the chemical and mechanical actions which leads to degradation of the fibres. The mechanical action is produced during the washing, rinsing, spin-drying or tumble-drying, when the latter takes place in a tumble dryer. This degradation of the fibres leads to the formation of fibrils at the surface of the textile which end up causing colored textiles to lose their radiance. This degradation also induces a decrease in the strength of the textile which, at the extreme, may lead to tearing of the fabrics. This degradation of textiles may be evaluated quantitatively either by a loss of the colors of colored textiles or by a reduction in the tear strength of the textile. It is generally necessary to carry out 10 to 20 cumulative machine washes in order to perceive this type of degradation.

Cleaning in a washing machine, which systematically includes a spin-drying operation, also leads to creased fabrics, which is accentuated during the tumble-drying stage, in particular by the formation of inter-fibre hydrogen bonds. It is thus necessary to iron the fabrics in order to make them look presentable.

In order to reduce the degradation of the fibres during washing or rinsing, the suppliers of chemical products or detergents have made use of changes in detergent formulations or have used certain specific additives.

Mention may be made in particular of detergents comprising no oxidizing system, but which have reduced cleaning capacities.

Silicone-based compounds have also been used, and in particular aminosilicones (US-A-4 585 563; WO 92/07927; WO 98/39401).

The Applicant has found that the use, in compositions for treating fabrics, in particular cotton-based fabrics, of nanoparticles or of a nanolatex of insoluble polymers makes it possible to prevent the degradation of the fabrics and/or to give them crease-resistance and/or softening properties.

Such compositions may especially be compositions for washing and/or rinsing and/or softening fabrics, for destaining fabrics before washing ("prespotting"), for tumble-drying wet fabrics in a tumble dryer or for ironing fabrics.

According to the invention, the expression "polymer nanoparticles" means particles with a diameter from about 10 to 500 nm, preferably from 20 to 300 nm, most particularly from 20 to 100 nm and even more particularly from 20 to 50 nm.

The expression "polymer nanolatex" means a stable aqueous dispersion of solid polymer nanoparticles with a mean size from about 10 to 500 nm, preferably from 20 to 300 nm, most particularly from 20 to 100 nm and even more particularly from 20 to 50 nm. Such a dispersion generally has a solids content from about 10% to 50% by weight and preferably from about 20% to 40% by weight.

A first subject of the invention consists of a composition for fabric care, characterized in that it comprises nanoparticles or at least one nanolatex of at least one polymer (P) which is insoluble under the working conditions of the said composition in an aqueous or wet medium.

A second subject of the invention consists of a process for fabric care by treating these fabrics with a composition, in an aqueous or wet medium, comprising nanoparticles or at least one nanolatex of at least one polymer (P) which is insoluble in the said medium.

A third subject of the invention consists of the use, in a composition for treating fabrics in an aqueous or wet medium, of nanoparticles or of at least one nanolatex of at least one polymer (P) which is insoluble in the said medium, as an agent for fabric care.

The composition and the working (or treatment) conditions may be in numerous forms.

The said composition may be

- in the form of a solid (powder, granules, tablets, etc.) or of a concentrated aqueous dispersion, placed in contact with the fabrics to be treated, after dilution in water;
- in the form of a concentrated dispersion placed beforehand on the dry fabrics to be treated before dilution in water;
- in the form of an aqueous dispersion to be placed directly on the dry fabrics to be treated without dilution or of a solid support (stick) comprising the said nanoparticles or the said nanolatex, to be applied directly to the dry fabrics to be treated;
- in the form of an insoluble solid support comprising the said nanoparticles or the said nanolatex of polymer (P) placed directly in contact with the wet fabrics to be treated.

Thus, the composition of the invention may be:

- a solid or liquid detergent formulation capable of directly forming a washing bath by dilution;
- a liquid rinsing and/or softening formulation capable of directly forming a rinsing and/or softening bath by dilution;
- a solid material, in particular a textile, comprising the said nanoparticles or the said nanolatex, which is intended to be placed in contact with wet fabrics in a tumble dryer (the said solid material is referred to hereinbelow as a "tumble dryer additive");
- an aqueous ironing formulation;
- a washing additive ("prespotter") intended to be placed on the dry fabrics prior to a washing operation using a detergent formulation containing or not containing the said nanoparticles or the said nanolatex (the said additive is referred to hereinbelow as a "prespotter").

The composition of the invention is particularly suitable for fabric care, especially for cotton-based fabrics, in particular fabrics containing at least 35% cotton.

The said polymer (P) preferably has a glass transition temperature Tg from about −40° C. to 150° C., preferably from about 0 to 100° C. and most particularly from about 10 to 80° C.

The term "polymer" means either a homopolymer or a copolymer derived from two or more monomers.

For good implementation of the invention, the said polymer (P) comprises:

- hydrophobic monomer units (N) that are uncharged or non-ionizable at the working pH of the composition of the invention, optionally at least one hydrophilic monomer unit (F) chosen from monomer units (F1) that are cationic or cationizable at the working pH of the said composition, (F2) that are amphoteric at the working pH of the said composition, (F3) that are anionic or anionizable at the working pH of the said composition, (F4) that are uncharged or non-ionizable, of hydrophilic nature, at the working pH of the said composition, or mixtures thereof and optionally at least one crosslinking unit (R).

The said monomer units (N) and (F) are preferably derived from α-β monoethylenically unsaturated monomers.

The said monomer units (R) are preferably derived from diethylenically unsaturated monomers.

The average molar mass of the said polymer (measured by gel permeation chromatography (GPC) THF and expressed as polystyrene equivalents) may preferably be at least 20 000.

As examples of monomers from which the hydrophobic units (N) are derived, mention may be made of:

vinylaromatic monomers such as styrene, vinyltoluene, etc., alkyl esters of α-β monoethylenically unsaturated acids such as methyl, ethyl, etc. acrylates and methacrylates, vinyl or allylic esters of saturated carboxylic acids, such as vinyl or allyl acetates, propionates or versatates, α-β monoethylenically unsaturated nitrites, such as acrylonitrile, etc.

As examples of monomers from which the cationic or cationizable hydrophilic units (F1) are derived, mention may be made of:

N,N-(dialkylamino-ω)-alkyl)amides of α-β monoethylenically unsaturated carboxylic acids such as N,N-dimethylaminomethyl acrylamide or methacrylamide, N,N-dimethylaminoethyl acrylamide or methacrylamide, N,N-dimethylamino-3-propyl acrylamide or methacrylamide and N,N-dimethylaminobutyl acrylamide or methacrylamide, αβ monoethylenically unsaturated amino esters, such as dimethylaminoethyl methacrylate (DMAM), dimethylaminopropyl methacrylate, di-tert-butylaminoethyl methacrylate or dipentylaminoethyl methacrylate, monomers that are precursors of amine functions, such as N-vinylformamide, N-vinylacetamide, etc., which generate primary amine functions by simple acidic or basic hydrolysis.

As examples of monomers from which the amphoteric hydrophilic units (F2) are derived, mention may be made of:

N,N-dimethyl-N-methacryloyloxyethyl-N-(3-sulpho-propyl) ammonium sulphobetaine (SPE from Raschig), N,N-dimethyl-N-(2-methacrylamidoethyl)-N-(3-sulpho-propyl) ammonium betaine (SPP from Raschig), 1-vinyl-3-(3-sulphopropyl)imidazolidium betaine or 1-(3-sulphopropyl)-2-vinylpyridinium betaine (SPV from Raschig), derivatives of the quaternization reaction of N-(dialkylamino-c-alkyl)amides of α-β ethylenically unsaturated carboxylic acids, such as N,N-dimethyl-aminomethyl acrylamide or methacrylamide, N,N-dimethylamino-3-propyl acrylamide or methacryl-amide, or ethylenically unsaturated amino esters, such as di-tert-butylaminoethyl methacrylate or dipentylaminoethyl methacrylate, with a chloroacetate of an alkali metal (in particular sodium) or of propane sultone.

As examples of monomers from which the anionic or anionizable hydrophilic units (F3) are derived, mention may be made of:

monomers containing at least one carboxylic function, such as α-β ethylenically unsaturated carboxylic acids or anhydrides, acrylic, methacrylic, maleic, fumaric or itaconic acids or anhydrides, N-methacroylalanine or N-acryloylhydroxyglycine, and water-soluble salts thereof, monomers containing at least one sulphate or sulphonate function, such as 2-sulphooxyethyl methacrylate, vinylbenzenesulphonic acid, allylsuiphonic acid, 2-acrylamido-2-methylpropanesulphonic acid, sulphoethyl acrylate or methacrylate, or sulphopropyl acrylate or methacrylate, and water-soluble salts thereof, monomers containing at least one phosphonate or phosphate function, such as vinyiphosphonic acid, esters of ethylenically unsaturated phosphates such as phosphates derived from hydroxyethyl methacrylate (EMPICRYL 6835 from Rhodia) and those derived from polyoxyalkylene methacrylates and water-soluble salts thereof, α-β monoethylenically unsaturated monomers that are precursors of anionic function(s), such as those whose hydrolysis generates carboxylate functions (tert-butyl acrylate, dimethylaminoethyl acrylate, maleic anhydride, etc.)

As examples of monomers from which the uncharged or non-ionizable hydrophilic units (F4) are derived, mention may be made of:

hydroxyalkyl esters of αaβ ethylenically unsaturated acids, such as hydroxyethyl, hydroxypropyl, etc. acrylates and methacrylates, α-β ethylenically unsaturated acid amides, such as acrylamide, N, N-dimethyl methacrylamide, N-methylolacrylamide, etc., α-β ethylenically unsaturated monomers bearing a water-soluble polyoxyalkylenated segment of the polyethylene oxide type, such as polyethylene oxide a-methacrylates (BISOMER S2OW, S1OW, etc. from Laporte) or a, &-dimethacrylates, SIPOMER BEM from Rhodia (polyoxyethylene o-behenyl methacrylate), SIPOMER SEM-25 from Rhodia (polyoxyethylene o-tristyrylphenyl methacrylate), etc., α-β ethylenically unsaturated monomers that are precursors of hydrophilic units or segments; such as vinyl acetate, which, once polymerized, may be hydrolysed to generate vinyl alcohol units or polyvinyl alcohol segments, α-β ethylenically unsaturated monomers of ureido type and in particular methacrylamidoethyl-2-imidazolidinone (SIPOMER WAM II from Rhodia).

As examples of monomers from which the crosslinking units (R) are derived, mention may be made is of:

divinylbenzene ethylene glycol dimethacrylate allyl methacrylate methylenebis(acrylamide)

glyoxal bis(acrylamide).

The said polymers (P) may be obtained in a known manner by free-radical polymerization in aqueous medium of ethylenically unsaturated monomers. The said nanolatices may be obtained in particular by free-radical emulsion polymerization in water.

Processes for obtaining nanoparticulate latices of small diameter are described in Colloid Polym. Sci. 266:462-469 (1988) and in Journal of Colloid and Interface Science. Vol.

89, No. 1, September 1982, pages 185 et seq. One method for preparing latices of particles with a mean size of less than 100 nm, in particular with a mean size ranging from 1 to 60 nm and most particularly from 5 to 40 nm, is described in EP-A-644 205.

The choice and relative amounts of the monomer(s) from which the unit(s) (N), (F) and (R) of the polymer (P) are derived are such that the said polymer (P) has a glass transition temperature Tg from about −40° C. to 150° C., preferably from about 0 to 100° C. and most particularly from about 10 to 80° C., and remains insoluble under the working conditions of the composition of the invention.

According to the invention, the said polymer (P) is considered as insoluble when less than 15% and preferably less than 10% of its weight is soluble in the aqueous or wet working medium of the composition of the invention, that is to say in particular under the temperature and pH conditions of the said medium.

The working pH for the composition of the invention may range from about 2 to about 12, depending on the desired use.

When it is a detergent formulation, the pH of the washing bath is generally from about 7 to 11 and preferably from 8 to 10.5;

a rinsing and/or softening formulation, the pH of the rinsing and/or softening bath is generally from about 2 to 8;

a tumble dryer additive, the pH to be considered is that of the residual water, which may be from about 2 to 9;

an aqueous ironing formulation, the pH of the said formulation is generally from about 5 to 9;

a prespotter, the pH to be considered is that of the washing bath for the operation following the washing, namely from about 7 to 11 and preferably from 8 to 10.5.

For good implementation of the invention, at least 70% of the total mass of the said polymer (P) is formed from hydrophobic unit(s) (N).

When hydrophilic units (F) are present, they preferably represent not more than 30% of the total mass of the polymer (P).

When crosslinking units (R) are present, they generally represent not more than 20%, preferably not more than 10% and most particularly not more than 5% of the total mass of the polymer (P).

A first embodiment of the invention consists of a composition (C1) comprising nanoparticles or at least one nanolatex of at least one uncharged or non-ionizable polymer (P1) comprising at least 70% of its weight of hydrophobic monomer units (N)

optionally at least 1% of its weight of uncharged or non-ionizable hydrophilic monomer units (F4)

optionally not more than 20% of its weight of uncharged or non-ionizable crosslinking units (R).

Preferably, according to this first embodiment, the said uncharged or non-ionizable polymer (P1) comprises:

at least 70% of its weight of hydrophobic monomer units (N)

from 3% to 30% of its weight of uncharged or non-ionizable hydrophilic monomer units (F4)

optionally not more than 20% and preferably not more than 10% of its weight of uncharged or non-ionizable crosslinking units (R).

The said uncharged or non-ionizable polymer (P1) may be used in any type of fabric care composition mentioned above, the working pH of which may range from 2 to 12, namely detergent formulations, rinsing and/or softening formulations, tumble dryer additives, aqueous ironing formulations or prespotters.

A second embodiment of the invention consists of a composition (C2) comprising nanoparticles or at least one nanolatex of at least one polymer (P2) containing anionic or anionizable units and being free of cationic or cationizable units, comprising at least 70% of its weight of hydrophobic monomer units (N)

at least 1% of its weight, preferably from 3% to 30% of its weight and most particularly from 1% to 20% of its weight, of anionic or anionizable hydrophilic monomer units (F3)

optionally not more than 29% of its weight of uncharged or non-ionizable hydrophilic monomer units (F4).

The said polymer (P2) can be used in fabric care compositions of non-cationic nature, namely detergent formulations, tumble dryer additives, aqueous ironing formulations or prespotters.

A third embodiment of the invention consists of a composition (C3) comprising nanoparticles or at least one nanolatex of at least one polymer (P3) containing amphoteric units, comprising at least 70% of its weight of hydrophobic monomer units (N)

at least 0.1% of its weight, preferably not more than 20% of its weight and most particularly not more than 10% of its weight, of amphoteric hydrophilic monomer units (F2)

optionally uncharged or non-ionizable hydrophilic monomer units (F4)

optionally cationic or cationizable hydrophilic monomer units (F1), the combination of hydrophilic monomer units (F) preferably representing at least 1% of the weight of the polymer (P3), and the molar ratio of the cationic charges to the anionic charges possibly ranging from 1/99 to 80/20 depending on the desired use of the said composition (C3).

The said polymer (P3) with a molar ratio of the cationic charges to the anionic charges ranging from 1/99 to 80/20 may be used in tumble dryer additives and aqueous ironing formulations.

The said polymer (P3) with a molar ratio of the cationic charges to the anionic charges ranging from 1/99 to 60/40 and preferably from 5/95 to 50/50 may also be used in detergent formulations and prespotters.

A fourth embodiment of the invention consists of a composition (C4) comprising nanoparticles or at least one nanolatex of at least one polymer (P4) containing both cationic or cationizable units and anionic or anionizable units, comprising at least 70% of its weight of hydrophobic monomer units (N)

cationic or cationizable hydrophilic monomer units (F1)

anionic or anionizable hydrophilic monomer units (F3)

optionally amphoteric hydrophilic monomer units (F2)

optionally uncharged or non-ionizable hydrophilic monomer units (F4), the combination of hydrophilic monomer units (F) preferably representing at least 1% of the weight of the polymer (P4), and the molar ratio of the cationic charges to the anionic charges possibly ranging from 1/99 to 80/20 depending on the desired use of the said composition (C4).

The said polymer (P4) with a molar ratio of the cationic charges to the anionic charges ranging from 1/99 to 80/20 may be used in tumble dryer additives and aqueous ironing formulations.

The said polymer (P4) with a molar ratio of the cationic charges to the anionic charges ranging from 1/99 to 60/40 and preferably from 5/95 to 50/50 may also be used in detergent formulations and prespotters.

A fifth embodiment of the invention consists of a composition (C5) comprising nanoparticles or at least one nanolatex of at least one polymer (P5) containing cationic or cationizable units and being free of anionic or anionizable units, comprising at least 70% of its weight of hydrophobic monomer units (N)

at least 1% of its weight, preferably from 3% to 30% of its weight and most particularly from 1% to 10% of its weight, of cationic or cationizable hydrophilic monomer units (F1)

optionally not more than 20% of its weight of uncharged or non-ionizable hydrophilic monomer units (F4).

The said polymer (P5) may be used in any type of fabric care composition mentioned above, the working pH of which may range from 2 to 12, namely detergent formulations, rinsing and/or softening formulations, tumble dryer additives, aqueous ironing formulations or prespotters.

In a most preferred manner, when the composition (C5) is a detergent composition, the said monomer units (F1) are cationizable units derived from at least one cationizable monomer with a pKa of less than 11 and preferably of less than 10.5.

As examples of nanoparticles or a nanolatex of polymer (P), mention may be made in particular of nanoparticles or a nanolatex of copolymers containing units derived from methyl methacrylate/butyl acrylate/hydroxyethyl methacrylate/methacrylic acid, the glass transition temperature Tg of which may range from 10° C. to 80° C., depending on the composition of the said polymer methyl methacrylate/ethylene glycol dimethacrylate/methacrylic acid, the glass transition temperature Tg of which may range from 10° C. to 80° C., depending on the composition of the said polymer styrene/divinylbenzene/methacrylic acid, the glass transition temperature Tg of which may range from 1000C to 140 0C, depending on the composition of the said polymer styrene/butyl acrylate/hydroxyethyl methacrylate/methacrylic acid, the glass transition temperature Tg of which may range from 10° C. to 80° C., depending on the composition of the said polymer Veova 10 (vinyl $C_{10}$ versatate)/methyl methacrylate/butyl acrylate/methacrylic acid, the glass transition temperature Tg of which may range from 10° C. to 80° C., depending on the composition of the said polymer methyl methacrylate/butyl acrylate/hydroxyethyl methacrylate/methacrylic acid/N, N-dimethyl-N-methacryloyloxyethyl-N. (3-suiphopropyl) ammonium sulphobetaine (SPE from Raschig), the glass transition temperature Tg of which may range from 10° C. to 80° C., depending on the composition of the said polymer methyl methacrylate/butyl acrylate/hydroxyethyl methacrylate/methacrylic acid/vinyiphosphonic acid, the glass transition temperature Tg of which may range from 10° C. to 80° C., depending on the composition of the said polymer methyl methacrylate/butyl acrylate/hydroxyethyl methacrylate/methacrylic acid/EMPICRYL 6835 from Rhodia, the glass transition temperature Tg of which may range from 100c to 800C, depending on the composition of the said polymer.

The amount of nanoparticles or of nanolatex of polymer (P) present in the care composition according to the invention may range from 0.05% to 10% as dry weight relative to the dry weight of the said composition, depending on the desired application.

Thus, the said polymer (P) may be used as follows:

| % of nanoparticles or nanolatex of polymer (P) (as dry weight) | In a care composition according to the invention used as |
|---|---|
| 0.05–5<br>preferably 0.1–3 | detergent formulation |
| 0.05–3<br>preferably 0.1–2 | rinsing and/or softening formulation |
| 0.05–10<br>preferably 0.1–5 | tumble dryer additive |
| 0.05–10<br>preferably 0.1–5 | ironing formulation |
| 0.05–10<br>preferably 0.1–5 | prespotter |

Other constituents may be present, along with the nanoparticles or the nanolatex of polymer (P), in the care composition according to the invention. The nature of these constituents depends on the desired use of the said composition.

Thus, when it is a detergent formulation, for washing fabrics, it generally comprises:

at least one natural and/or synthetic surfactant, at least one detergent adjuvant ("builder")

optionally a n oxidizing agent or system, and series of specific additives.

The detergent formulation may comprise surfactants in an amount corresponding to about 3% to 40% by weight relative to the detergent formulation, these surfactants being such as Anionic Sulfactants alkyl ester sulphonates of formula R—CH($SO_3$M)—COO', in which R represents a $C_8$–$C_{20}$ and preferably $C_{10}$–$C_{16}$ alkyl radical, R' represents a $C_1$–$C_6$ and preferably $C_1$–$C_3$ alkyl radical and M represents an alkali metal (sodium, potassium or lithium) cation, a substituted or unsubstituted ammonium (methyl-, dimethyl-, trimethyl or tetramethylammonium, dimethylpiperidinium, etc.) or an alkanolamine derivative (monoethanolamine, diethanolamine, triethanolamine, etc.). Mention may be made most particularly of methyl ester sulphonates in which the radical R is $C_{14}$–$C_{16}$;

alkyl sulphates of formula ROSO3M, in which R represents a $C_5$–$C_{24}$ and preferably $C_{10}$–$C_{18}$ alkyl or hydroxyalkyl radical, M representing a hydrogen atom or a cation of the same definition as above, and also the ethoxylenated (EO) and/or propoxylenated (P0) derivatives thereof, containing on average from 0.5 to 30 and preferably from 0.5 to 10 EO and/or P0 units;

alkylamide sulphates of formula RCONHR'$OSO_3$M in which R represents a $C_2$–$C_{22}$ and preferably $C_6$–$C_{20}$ alkyl radical, R' represents a $C_2$–$C_3$ alkyl radical, M representing a hydrogen atom or a cation of the same definition as above, and also the eihoxylenated (EO) and/or propoxylenated (P0) derivatives thereof, containing on average from 0.5 to 60 EO and/or P0 units;

saturated or unsaturated $C_8$–$C_{24}$ and preferably $C_{14}$–$C_{20}$ fatty acid salts, $C_9$–$C_{20}$ alkylbenzenesulphonates, primary or secondary $C_8$–$C_{22}$ alkylsulphonates, alkyl-glyceryl sulphonates, the sulphonated polycarboxylic acids described in GB-A-1 082 179, paraffin sulphonates, N-acyl N-alkyltaurates, alkyl phosphates, isethionates, alkyl succinamates, alkyl sulphosuccinates, sulpho- succinate monoesters or diesters, N-acyl sarcosinates, alkyiglycoside sulphates, polyethoxycarboxylates; the cation being an alkali metal (sodium, potassium or lithium), a substituted or unsubstituted ammonium residue (methyl-, dimethyl-, trimethyl- or tetramethyl-animonium, dimethylpiperidinium, etc.) or an alkanolamine derivative (monoethanolamine, diethanolamine, triethanolamine, etc.);

Nonionic surfactants polyoxyalkylenated (polyoxyethylenated, polyoxypropylenated or polyoxybutylenated) alkylphenols in which the alkyl substituent is $C_6$–$C_{12}$ and containing from 5 to 25 oxyalkylene units; examples which may be mentioned are the products TRITON X-45, X-114, X-100 or X-102 sold by Rohm & Haas Co.;

glucosamide, glucamide or glycerolamide;

polyoxyalkylenated $C_8$–$C_{22}$ aliphatic alcohols containing from 1 to 25 oxyalkylene (oxyethylene or oxypropylene) units; examples which may be mentioned are the products TERGITOL 15-S-9 and TERGITOL 24-L-6 NMW sold by Union Carbide Corp., NEODOL 45-9, NEODOL 23-65, NEODOL 45-7 and NEODOL 45-4 sold by Shell Chemical Co., and KYRO EOB sold by The Procter & Gamble Co.;

products resulting from the condensation of ethylene oxide or the compound resulting from the condensation of propylene oxide with propylene glycol, such as the products sold by BASF;

products resulting from the condensation of ethylene oxide or the compound resulting from the condensation of propylene oxide with ethylenediamine, such as the TETRONIC products sold by BASF;

amine oxides such as $C_{10}$–$C_{18}$ alkyl dimethylamine oxides and $C_8$–$C_{22}$ alkoxy ethyl dihydroxyethylamine oxides;

the alkylpolyglycosides described in US-A-4 565 647;

$C_8$–$C_{20}$ fatty acid amides;

ethoxylated fatty acids;

ethoxylated fatty amides;

ethoxylated amines.

Amphoteric and Zwitterionic Surfactants alkyldimethylbetaines, alkylamidopropyldimethylbetaines, alkyltrimethylsulphobetaines and the products of condensation of fatty acids and of protein hydrolysates;

alkyl amphoacetates or alkyl amphodiacetates in which the alkyl group contains from 6 to 20 carbon atoms.

The detergent adjuvants ("builders") for improving the surfactant properties may be used in amounts corresponding to about 5–50% and preferably to about 5–30% by weight for the liquid detergent formulations or to about 10–80% and preferably 15–50% by weight for the powder detergent formulations, these detergent adjuvants being such as:

Mineral Detergent Adjuvants polyphosphates (tripolyphosphates, pyrophosphates, orthophosphates or hexametaphosphates) of alkali metals, of ammonium or of alkanolamines tetraborates or borate precursors;

silicates, in particular those with an $SiO_2/Na_2O$ ratio from about 1.6/1 to 3.2/1 and the lamellar silicates described in US-A-4 664 839;

alkali metal or alkaline-earth metal carbonates (bicarbonates, sesquicarbonates);

cogranulates of alkali metal silicate hydrates and of alkali metal (sodium or potassium) carbonates that are rich in silicon atoms in Q2 or Q3 form, described in EP-A-488 868;

crystalline or amorphous aluminosilicates of alkali metals (sodium or potassium) or of ammonium, such as zeolites A, P, X, etc.; zeolite A with a particle size of about 0.1–10 micrometers is preferred.

Organic Detergent Adjuvants water-soluble polyphosphonates (ethane 1-hydroxy-1,1-diphosphonates, methylenediphosphonate salts, etc.);

water-soluble salts of carboxylic polymers or copolymers or water-soluble salts thereof, such as:

polycarboxylate ethers (oxydisuccinic acid and its salts, monosuccinic acid tartrate and its salts, disuccinic acid tartrate and its salts);

hydroxypolycarboxylate ethers;

citric acid and its salts, mellitic acid and succinic acid and their salts;

polyacetic acid salts (ethylenediaminetetraacetates, nitrilotriacetates, N-(2-hydroxyethyl)nitrilodiacetates);

$C_5$–$C_{20}$ alkyl succinic acids and their salts (2-dodecenylsuccinates, lauryl succinates);

carboxylic polyacetal esters;

polyaspartic acid and polyglutamic acid and their salts;

polyimides derived from the polycondensation of aspartic acid and/or of glutamic acid;

polycarboxymethyl derivatives of glutamic acid or of other amino acids.

The detergent formulation may also comprise at least one oxygen-releasing bleaching agent comprising a percompound, preferably a persalt.

The said bleaching agent may be present in an amount corresponding to about 1% to 30% and preferably from 4% to 20% by weight relative to the detergent formulation.

As examples of percompounds which may be used as bleaching agents, mention should be made in particular of perborates such as sodium perborate monohydrate or tetrahydrate; peroxygenated compounds such as sodium carbonate peroxyhydrate, pyrophosphate peroxyhydrate, urea peroxyhydrate, sodium peroxide and sodium persulphate.

The preferred bleaching agents are sodium perborate monohydrate or tetrahydrate and/or sodium carbonate peroxyhydrate.

The said agents are generally combined with a bleaching activator which generates, in situ in the washing medium, a peroxycarboxylic acid in an amount corresponding to about 0.1% to 12% and preferably from 0.5% to 8% by weight relative to the detergent formulation. Among these activators, mention may be made of tetraacetylethylenediamine, tetraacetyl-methylenediamine, tetraacetylglycoluryl, sodium p-acetoxybenzenesulphonate, pentaacetylglucose and octaacetyllactose.

Mention may also be made of non-oxygenated bleaching agents, which act by photo-activation in the presence of oxygen, these being agents such as sulphonated aluminium and/or zinc phthalocyanins.

The detergent formulation may also comprise soil-release agents, anti-redeposition agents, chelating agents, dispersants, fluorescers, foam suppressants, softeners, enzymes and various other additives.

Soil-Release Agents

These may be used in amounts of about 0.01–10%, preferably about 0.1–5% and more preferably about 0.2–3% by weight.

Mention may be made more particularly of agents such as:

cellulose derivatives such as cellulose hydroxy ethers, methylcellulose, ethylcellulose, hydroxypropylmethylcellulose or hydroxybutylmethylcellulose;

polyvinyl esters grafted onto polyalkylene trunks, such as polyvinyl acetates grafted onto polyoxyethylene trunks (EP-A-219 048);

polyvinyl alcohols;

polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio from about 1/10 to 10/1 and preferably from about 1/1 to 9/1, the polyoxyethylene terephthalates containing polyoxyethylene units with a molecular weight from about 300 to 5 000 and preferably from about 600 to 5 000 (US-A-3 959 230, US-A-3 893 929, US-A-4 116 896, US-A-4 702 857, US-A-4 770 666);

sulphonated polyester oligomers obtained by sulphonation of an oligomer derived from ethoxylated allylic alcohol, from dimethyl terephthalate and from 1,2-propylene diol, containing from 1 to 4 sulphonated groups (US-A-4 968 451);

polyester copolymers based on propylene terephthalate and polyoxyethylene terephthalate units and ending with ethyl or methyl units (US-A-4 711 730) or polyester oligomers ending with alkylpolyethoxy groups (US-A-4 702 857) or sulphopolyethoxy (US-A-4 721 580) or sulphoaroyl (US-A-4 877 896) anionic groups;

sulphonated polyester copolymers derived from terephthalic, isophthalic and sulphoisophthalic acid, anhydride or diester and from a diol (FR-A-2 720 399).

Anti-Redeposition Agents

These may be used in amounts generally of about 0.01–10% by weight for a powder detergent formulation or about 0.01–5% by weight for a liquid detergent formulation.

Mention may be made in particular of agents such as:

ethoxylated monoamines or polyamines, and ethoxylated amine polymers (US-A-4 597 898, EP-A-11 984);

carboxymethylcellulose;

sulphonated polyester oligomers obtained by condensation of isophthalic acid, dimethyl sulpho-succinate and diethylene glycol (FR-A-2 236 926);

polyvinylpyrrolidones.

Chelating Agents

Agents for chelating iron and magnesium may be present in amounts of about 0.1–10% and preferably of about 0.1–3% by weight.

Mention may be made, inter alia, of:

aminocarboxylates such as ethylenediaminetetra-acetates, hydroxyethylethylenediaminetriacetates and nitrilotriacetates;

aminophosphonates such as nitrilotris (methylene-phosphonates);

polyfunctional aromatic compounds such as dihydroxydisulphobenzenes.

Polymeric Dispersants

These may be present in an amount of about 0.1–7% by weight, to control the calcium and magnesium hardness, these being agents such as:

water-soluble polycarboxylic acid salts with a molecular mass from about 2 000 to 100 000, obtained by polymerization or copolymerization of ethylenically unsaturated carboxylic acids such as acrylic acid, maleic acid or anhydride, fumaric acid, itaconic acid, aconitic acid, mesaconic acid, citraconic acid or methylenemalonic acid, and most particularly polyacrylates with a molecular mass from about 2 000 to 10 000 (US-A-3 308 067), copolymers of arylic acid and of maleic anhydride with a molecular mass from about 5 000 to 75 000 (EP-A-66 915);

polyethylene glycols with a molecular mass from about 1 000 to 50 000.

Fluorescers (Brighteners)

These may be present in an amount of about 0.05–1.2% by weight, these being agents such as:

stilbene, pyrazoline, coumarin, fumaric acid, cinnamic acid, azole, methinecyanin, thiophene, etc. derivatives ("The production and application of fluorescent brightening agents" -M. Zahradnik, published by John Wiley & Sons, New York, 1982).

Foam Suppressants

These may be present in amounts which may be up to 5% by weight, these being agents such as:

$C_{10}$–$C_{24}$ monocarboxylic fatty acids or alkali metal, ammonium or alkanolamine salts thereof, and fatty acid triglycerides;

saturated or unsaturated aliphatic, alicyclic, aromatic or heterocyclic hydrocarbons, such as paraffins and waxes;

N-alkylaminotriazines;

monostearyl phosphates and monostearyl alkyl phosphates;

polyorganosiloxane oils or resins optionally combined with silica particles.

Softeners

These may be present in amounts of about 0.5–10% by weight, these being agents such as clays.

Enzymes

These may be present in an amount which may be up to 5 mg by weight and preferably of about 0.05–3 mg of active enzyme/g of detergent formulation, these being enzymes such as:

proteases, amylases, lipases, cellulases and peroxidases (US-A-3 553 139, US-A-4 101 457, US-A-4 507 219, US-A-4 261 868).

Other Additives

Mention may be made, inter alia, of:

buffers, fragrances, pigments.

The detergent formulation may be used, in particular in a washing machine, in a proportion of from 0.5 g/l to 20 g/l and preferably from 2 g/l to 10 g/l to carry out washing operations at a temperature from about 25 to 90° C.

A second embodiment of the care composition of the invention consists of an aqueous liquid formulation for rinsing and/or softening fabrics.

It may be used in a proportion of from 0.2 to 10 g/l and preferably from 2 to 10 g/l.

Along with the nanoparticles or the nanolatex of polymer (P), there may be present other constituents of the type such as:

combinations of cationic surfactants (triethanolamine diester quaternized with dimethyl sulphate, N-methyl-imidazoline tallow ester methyl sulphate, dialkyl-dimethylammonium chloride, alkylbenzyldimethylammonium chloride, methyl alkylimidazolinium sulphate, methyl methylbis (alkylamidoethyl)-2-hydroxyethylammonium sulphate, etc.) in an amount which may range from 3% to 50% and preferably from 4% to 30% of the said formulation, optionally combined with nonionic surfactants (ethoxylated fatty alcohols, ethoxylated alkylphenols, etc.) in an amount which may be up to 3%;

optical brighteners (0.1% to 0.2%);

optionally, colour-fast agents (polyvinylpyrrolidone, polyvinyloxazolidone, polymethacrylamide, etc. 0.03% to 25% and preferably 0.1% to 15%), colorants, fragrances, solvents, in particular alcohols (methanol, ethanol, propanol, isopropanol, ethylene glycol or glycerol), foam limiters.

A third embodiment of the care composition of the invention consists of an additive for drying fabrics in a suitable tumble dryer.

The said additive comprises a flexible solid support consisting, for example, of a strip of woven or nonwoven textile or a sheet of cellulose, comprising nanoparticles or impregnated with the nanolatex of polymer (P); the said additive is introduced at the time of tumble-drying into the wet fabrics to be dried at a temperature from about 50 to 80° C. for 10 to 60 minutes.

The said additive may also comprise cationic softeners (up to 99%) and color-fast agents (up to 80%), such as those mentioned above.

A fourth embodiment of the care composition of the invention consists of an ironing formulation which may be sprayed directly onto the dry fabrics before ironing.

The said formulation may also contain silicone-based polymers (from 0.2% to 5%), nonionic surfactants (from 0.5% to 5%) or anionic surfactants (from 0.5% to 5%), fragrances (0.1% to 3%) or cellulose derivatives (0.1% to 3%), for instance starch; spraying the said formulation onto the fabrics makes it easier to iron them and limits the creasing of the fabrics when they are worn.

A fifth embodiment of the care composition of the invention consists of a prespotter which is in the form of an aqueous dispersion or a solid (stick).

Along with the nanoparticles or the nanolatex of polymer (P), there may be present other constituents of the type such as:

anionic surfactants such as those already mentioned above, in an amount of at least 5% of the weight of the composition nonionic surfactants such as those already mentioned above, in an amount which may range from 15% to 40% of the weight of the composition aliphatic hydrocarbons, in an amount which can range from 5% to 20% of the weight of the composition.

A second subject of the invention consists of a process for caring for fabric's by treating them with a composition, in an aqueous or wet medium, comprising at least nanoparticles or a nanolatex of at least one polymer (P) that is insoluble in the said medium.

The type of composition, and also the amounts of polymer (P) and other additives which may be used, have already been mentioned above.

A third subject of the invention consists of the use, in a composition for treating fabrics in an aqueous or wet medium, of nanoparticles or of at least one nanolatex of at least one polymer (P) that is insoluble in the said medium, as a fabric care agent.

The type of composition, and also the amounts of polymer (P) and other additives which may be used, have already been mentioned above.

The said nanoparticles or the said nanolatex protect the fabrics in particular against physical or chemical degradation and/or give them benefits such as softening and/or crease-resistance properties.

The diameters of the nanoparticles or nanolatices of polymer according to the invention may be determined in a well-known manner by light scattering or by transmission electron microscopy.

The examples which follow are given for illustrative purposes.

The polymer (P) latices used to prepare the formulations in the examples of the invention are the latices (I) and (II) below:

Latex (I) of methyl methacrylate/butyl acrylate/hydroxyethyl methacrylate/methacrylic acid/N,N-dimethyl-N-meth-acryloyloxyethyl-N-(3-sulphopropyl)ammonium sulphobetaine (SPE from Raschig)

in a mass ratio between the various monomers of 42.3/35.4/15.8/4.2/2.2 the glass transition temperature Tg of which is about 41° C.

having a mean particle size from about 35 to 45 nm (determination by light scattering using a Malvern Instrument Zetasizer machine) and a solids content of about 30%.

Latex (II) of methyl methacrylate/butyl acrylate/hydroxyethyl methacrylate/methacrylic acid, in a mass ratio between the various monomers of 37/55/5/3 the glass transition temperature Tg of which is about 17 ° C.

having a mean particle size from about 30 to 35 nm (determination by light scattering using a Malvern Instrument Zetasizer machine) and a solids content of about 30%.

Detergent formulation

| Constituents | Formulation (A) with P % by weight | (B) colour without P % by weight | (C) without P % by weight |
|---|---|---|---|
| NaTPP | 40 | | |
| Zeolite 4A | 0 | 25 | 25 |
| 2 $SiO_2$, $Na_2O$ silicate | 5 | 5 | 5 |
| Sodium carbonate | 5 | 15 | 15 |
| Acrylate/maleate copolymer SOKALAN CP5 (BASF) | 0 | 5 | 5 |
| Sodium sulphate | 8 | 21 | 8 |
| CMC BLANOSE 7MXF (Hercules) | 1 | 1 | 1 |
| Perborate monohydrate | 15 | 0 | 15 |
| Granulated TAED | 5 | 0 | 5 |
| Anionic surfactant Laurylbenzene sulphate (Nansa) | 6 | 8 | 6 |
| Nonionic surfactant SYMPERONIC A3 (3 EO ethoxylated alcohol - ICI) | 3 | 5 | 3 |
| Nonionic surfactant SYMPERONIC A9 (9 EO ethoxylated alcohol - ICI) | 9 | 11 | 9 |
| Enzymes (esterases, amylases, cellulase, protease) | 0.5 | 0.5 | 0.5 |
| Fragrances | 1 | 1 | 1 |
| Latex (I) (% solids) | 1.0 | 1.0 | 1.0 |

-continued

Detergent formulation

| Constituents | Formulation (A) with P % by weight | (B) colour without P % by weight | (C) without P % by weight |
|---|---|---|---|
| Polyvinylpyrrolidone | 0 | 1 | 0 |
| Soil-release sulphonated copolyester REPEL-O-TEX PF 594 from Rhodia | 0.5 | 0.5 | 0.5 |

washing operation is carried out in a Tergotometer laboratory machine which is well known in the profession to detergent composition formulators. The machine simulates the mechanical and thermal effects of pulsating-type American washing machines, but, by virtue of the presence of 6 washing drums, it makes it possible to carry out simultaneous series of tests with an appreciable saving in time.

25×25 cm test pieces are cut from unfinished cotton. The cotton test pieces are first ironed so that they all have the same level of creasing before washing.

They are then washed using the above detergent formulation containing latex (I) and rinsed once, under the following conditions:

number of test pieces per Tergotometer drum: 2
volume of water: 1 litre
water of French hardness 300TH obtained by suitable dilution of CONTREXÉVILLE brand mineral water
washing product concentration: 5 g/l
washing temperature: 40°C.
washing time: 20 mm
spin speed of the Tergotometer: 100 rpm
rinsing with cold water (about 30° TH
rinsing time: 5 minutes The test pieces are then creased under a 3 kg press for 20 seconds, after which they are dried vertically overnight.

The same operation is carried out using the same detergent formulation, but free of latex (I).

A digital color photograph is then taken of the dry test pieces, which is then converted into 256 grey scale levels (grey scale from 0 to 255).

The number of pixels corresponding to each grey scale level are counted.

For each histogram obtained, the standard deviation $\sigma$ of the distribution of the grey scale level is measured. $\sigma 1$ corresponds to the standard deviation obtained with the detergent formulation containing no latex. $\sigma 2$ corresponds to the standard deviation obtained with the detergent formulation containing latex (I).

The performance value is given by the equation $-\Delta\sigma=\sigma 2-\sigma 1$ The performance values obtained are as follows:

| Formulation | (A) | (B) | (C) |
|---|---|---|---|
| $-\Delta\sigma$ | 3.5 | 4 | 4.5 |

These positive values of $-\Delta\sigma$ are representative of a crease-resistance property provided by the detergent formulation comprising the latex according to the invention.

EXAMPLE 2

Rinsing/Softening Formulation

| Constituents | % by weight |
|---|---|
| Cationic surfactant: ditallow dimethylammonium chloride | 5% |
| Fragrance | 1% |
| HCl to obtain a pH = 3 | 0.2% |
| Latex (I) or (II) (% solids) | 2% |

The invention claimed is:

1. A fabric treating composition in the form of a solid or concentrated aqueous dispersion which comprises:

(A) from 0.05% to 10% by weight of nanoparticles or at least one nanolatex of at least one addition polymer (P3) which is insoluble under the working conditions of said composition in an aqueous or wet medium, said addition polymer (P3) containing amphoteric units, and comprising:

(1) at least 70% of the total mass of said polymer of hydrophobic monomer units (N) derived from vinylaromatic monomers, alkyl esters of α-β monoethylenically unsaturated acids, vinyl or allylic esters of saturated carboxylic acids, or a-F3 monoethylenically unsaturated nitriles;

(2) at least 0.1% and not more than 20% of the total mass of said polymer of amphoteric hydrophilic monomer units (F2) derived from N,N-dimethyl-N methacryloyloxyethyl-N-(3-suiphopropyl) ammonium sulphobetaine, N,N-dimethyl-N- (2-methacrylamidoethyl)-N-(3-sulphopropyl) ammonium betaine, 1-vinyl-3-(3-suiphopropyl) imidazolidium betaine, 1-(3-sulphopropyl)-2-vinylpyridinium betaine, or derivatives of the quaternization reaction of N-(dialkylamino-ω-alkyl) amides of α-β ethylenically unsaturated carboxylic acids or α-β monoethylenically unsaturated amino esters, with a chloroacetate of an alkali metal or with propane sultone;

(3) optionally, uncharged or non-ionizable hydrophilic monomer units (F4) derived from hydroxyalkyl esters of α-β monoethylenically unsaturated acid amides, α-β monoethylenically unsaturated acid amides, α-β ethylenically unsaturated monomers bearing a water-soluble polyoxyalkylenated segment, α-β monoethylenically unsaturated monomers that are precursors of vinyl alcohol units or of polyvinyl alcohol segments by polymerization and then hydrolysis, or methacrylamidoethyl-2-imidazolidinone;

(4) optionally, cationic or cationizable hydrophilic monomer units (F1) derived from N,N-dialkylamino-ω-alkyl)amides of α-β monoethylenically unsaturated carboxylic acids, α-β monoethylenically unsaturated amino esters or monomers that are precursors of primary amine functions by hydrolysis; and (5) optionally, at least one crosslinking unit (R) derived from divinylbenzene, ethylene glycol dimethacrylate, allyl methacrylate, methylenebis(acrylamide) or glyoxal bis (acrylamide);

(B) from about 3% to about 50% by weight of at least one anionic, cationic, nonionic and/or amphoteric surfactant; and (C) optionally, other detergent adjuvants;

the combination of hydrophilic monomer units representing at least 1% of the weight of the polymer (P3), the molar ratio of cationic charges to anionic charges ranging from 1/99 to 80/20, said nanoparticles or the said nanolatex have a mean particle size of polymer of from 10 to 500 nm; and the addition polymer (P3) being present in an amount sufficient to impart crease-resistant, softening or pre-spotting characteristics to the fabric treating composition.

2. Composition according to claim 1, wherein said nanolatex has a solids content from 10% to 50% by weight.

3. The composition according to claim 2, wherein said nanolatex has a solids content of 20% to 40% by weight.

4. Composition according to claim 1, which is in the form of a solid or concentrated aqueous dispersion, placed in contact with the fabrics to be treated, after dilution in water; and comprising:

a concentrated dispersion placed beforehand on the dry fabrics to be treated before dilution in water;

an aqueous dispersion placed directly on the dry fabrics to be treated without dilution or a solid support comprising said fabric treating composition, to be applied directly to the dry fabrics to be treated; or an insoluble solid support comprising the said fabric treating composition placed directly in contact with the wet fabrics to be treated.

5. Composition according to claim 1, wherein said composition is a solid or liquid detergent formulation comprising from 0.05% to 5% of the said nanoparticles or of the said nanolatex, expressed as dry weight, capable of directly forming a washing bath by dilution;

a liquid rinsing and/or softening formulation comprising from 0.05% to 3% of the said nanoparticles or of the said nanolatex, expressed as dry weight, capable of directly forming a rinsing and/or softening bath by dilution;

a solid textile material comprising from 0.05% to 10% of the said nanoparticles or of the said nanolatex, expressed as dry weight, which is to be placed in contact with wet fabrics in a tumble dryer;

an aqueous ironing formulation comprising from 0.05% to 10% of the said nanoparticles or of the said nanolatex, expressed as dry weight;

a washing additive comprising from 0.05% to 10% of the said nanoparticles or of the said nanolatex, expressed as dry weight, to be placed on the dry fabrics prior to a washing operation using a detergent formulation containing or not containing the said particles or the said nanolatex.

6. Composition according to claim 1, wherein the choice and the relative amounts of the monomer(s) from which the units(s) of the polymer are derived are such that the said polymer has a glass transition temperature Tg from −40° C. to 150° C., and remains insoluble under the working conditions of the composition.

7. Composition according to claim 1, wherein said composition is a tumble dryer additive or an aqueous ironing formulation when the molar ratio of the cationic charges to the anionic charges ranges from 1/99 to 80/20.

8. Composition according to claim 1, wherein said composition is a detergent formulation, a prespotter, a tumble dryer additive or an aqueous ironing formulation, and the molar ratio of the cationic charges to the anionic charges ranges from 1/99 to 60/40.

9. The composition according to claim 1, wherein the mean particle size of the polymer is from 20 to 300 nm.

10. The composition according to claim 1, wherein the mean particle size of the polymer is from 20 to 100 nm.

11. The composition according to claim 1, wherein the mean particle size of the polymer is from 20 to 50 nm.

12. The composition according to claim 1, wherein the polymer (P3) comprises not more than 10% by weight of amphoteric hydrophilic monomer units (F2).

13. Process for imparting crease-resistance or facilitating ironing of fabrics comprising treating said fabrics in an aqueous or wet medium with the composition of claim 1.

* * * * *